US005261586A

United States Patent [19]

Chen

[11] Patent Number: 5,261,586

[45] Date of Patent: Nov. 16, 1993

[54] YARN FEEDING DEVICE WITH A GUIDING FLANGE

[76] Inventor: Jen-Fu Chen, 20, Lane 13, Chin Shan S. Road, Sec. 2, Taipei, Taiwan

[21] Appl. No.: 858,234

[22] Filed: Mar. 26, 1992

[51] Int. Cl.[5] ..... B65H 51/20; D04B 15/48

[52] U.S. Cl. ..... 226/171; 66/132 T; 242/47.01

[58] Field of Search ..... 242/47.01, 47.12; 226/34, 35, 171; 66/132 R, 132 T

[56] References Cited

U.S. PATENT DOCUMENTS 4,153,213 5/1979 Jacobsson ..... 242/47.01
4,298,172 11/1981 Hellstrom ..... 242/47.01
4,355,747 10/1982 Vinas ..... 226/35 X
4,489,899 12/1984 Calamani et al. ..... 226/34 X
4,545,543 10/1985 Plucknett ..... 242/47.01
4,799,517 1/1989 Bucher ..... 242/47.01 X
4,820,731 4/1989 Rosen ..... 242/47.01 X

*Primary Examiner*—Daniel P. Stodola
*Assistant Examiner*—Paul T. Bowen
*Attorney, Agent, or Firm*—Pro-Techtor International

[57] ABSTRACT

A yarn feeding device provided with an annular flange which outward extends from a lower edge of a pressing area of a driving belt on a circumferential surface of the yarn feeding drum, so as to instantly restore abnormally displaced yarn or driving belt to its true position for continuously normally feeding the yarn.

8 Claims, 5 Drawing Sheets

FIG. 7
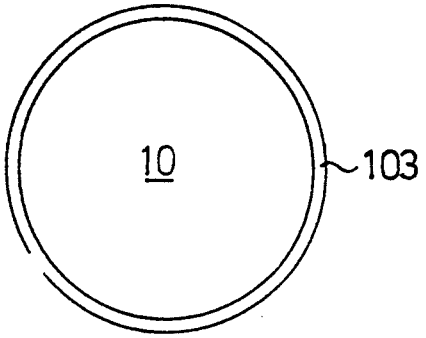
FIG. 8
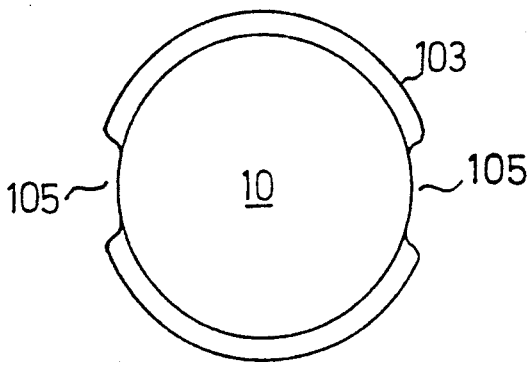
FIG. 9
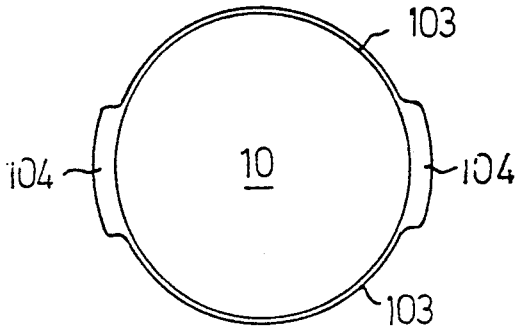
FIG. 10
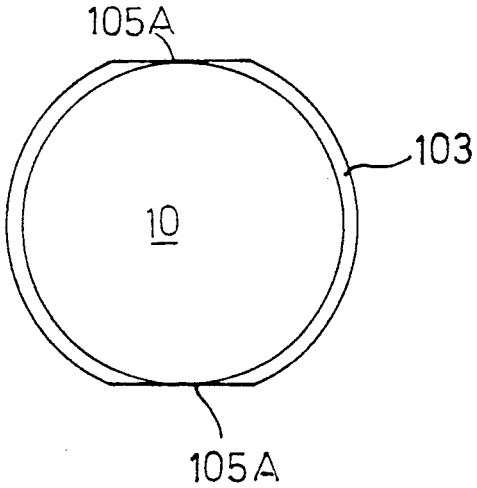
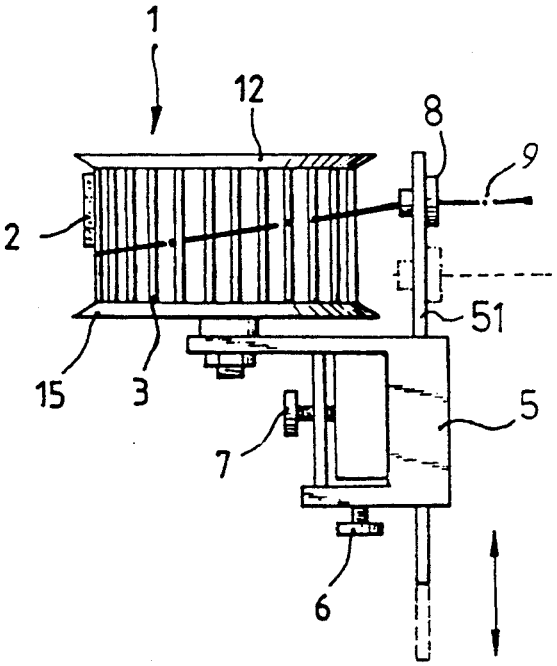
FIG. 11
(PRIOR ART)

YARN FEEDING DEVICE WITH A GUIDING FLANGE

BACKGROUND OF THE INVENTION

The present invention relates to an improved yarn feeding drum, and more particularly to an improved yarn feeding drum with a guiding flange on its circumferential surface capable of automatically guiding the yarn or driving belt into true position for feeding the yarn.

As shown in FIG. 11, a conventional yarn feeding device includes a support body 5, a yarn feeding drum 1 freely rotatably disposed thereon, a pair of yarn guide eyes 8 mounted on a guiding frame 51. In normal positive yarn feeding operation, the yarn guiding frame 51 is located in a position indicated by solid line in FIG. 11. When the specification of the fabric is changed and the tension of the yarn needs to be adjusted or the yarn feeding conditions need to be changed and thus a trial run is required, or in a negative irregular yarn feeding operation, the yarn guiding frame 51 is necessary to be operated downward to a position indicated by phantom line in FIG. 11, so as to prevent the yarn from being pressed by the driving belt 2. Otherwise, in general positive yarn feeding operation, the yarn is rarely not pressed by the driving belt.

However, in case the yarn wound on tapered cone or tube is poor or the yarn outgoing resistance is relatively great, the yarn will be abnormally fed in an intermittently shaking manner. On the other hand, when a rough count yarn with larger weight is fed, a greater rotary inertia is created under high speed yarn feeding operation, as a result, the yarn is unable to be sufficiently pressed by the driving belt on the circumferential surface of the drum and is likely to slip away from the pressing -area of the driving belt, so that the high and low yarn tension will alternate and sometimes the yarn will even drop from the lower edge of the driving belt and become released from the pressing of the driving belt. Such abnormal yarn feeding operation will cause defects or even breakages of the fabrics and thus waste the same.

Moreover, the positive yarn feeding operations of general yarn feeding drums are almost designed for fine count yarn, in which the frictional coefficients of the driving belt and the circumferential surface of the yarn feeding drum and the pressing force exterted on the yarn are constant. However, in case an open end rough count yarn feeding operation is alternatively performed, because the rough count yarn has a less flexibility than a ring fine count yarn and has a weight much greater than the ring fine count yarn, under the same operation conditions, the rough count yarn is likely to drop from the lower edge of belt and escape from being pressed by the belt as shown in FIG. 11. As a consequence, the quality of the resultant fabric is poor and unsatisfactory. In addition, although the pressing position and pressing angle of the driving belt 2 on the yarn feeding drum can be adjusted by means of adjusting the adjusting screws 6 and 7 (referring to FIG. 11), in case the adjusting screws 6 and 7 are loosened due to the vibration the yarn feeding device, the driving belt will displace from the normal pressing position and angle and abnormally move up and down. As a result, the yarn feeding tension will become extremely unstable and if the operator fails to secure the screws in time, great amount of fabric with ununified quality will be produced to cause great loss.

SUMMARY OF THE INVENTION

It is therefore a primary object of this invention to provide an improved yarn feeding drum capable of automatically guiding yarns and driving belt to their true positions for feeding the yarns, whereby in positive yarn feeding operation of rough count yarn, the operation conditions are not necessary to be adjusted with the rough count yarn completely pressed by the driving belt on the yarn feeding drum to accomplish a stable and constant yarn feeding operation.

It is a further object of this invention to provide the above improved yarn feeding drum which not only can prevent the rough count yarn from dropping out of the pressing area of the driving belt but also can keep the driving belt in its true position to stably press the yarn even when the adjusting screws of the yarn guiding frame are somewhat loosened.

According to the above objects, the circumferential surface of the present yarn feeding drum is formed with a smooth outward projecting annular flange portion or an outward projecting annular flange having at least one recess. The flange portion is located at a lower edge position of the driving belt on the circumferential surface of the yarn feeding drum so as to effectively prevent the yarn from slipping downward and automatically make the yarn always pressed by the driving belt and instantly make the abnormally displaced driving belt restore to its true postion for continuously stably feeding the yarn.

The present invention can be best understood through the following description and accompanying drawings, wherein:

BRIEF DESCRIPTION OF THE DRAWINGS

FIG. 7 is a sectional view taken on line A—A in FIG. 1, showing top view of the first embodiment of the annular flange of this invention;

FIG. 8 is a plan view of the second embodiment of the annular flange of this invention;

FIG. 9 is a plan view of the third embodiment of the annular flange of this invention;

FIG. 10 is a plan view of the fourth embodiment of the annular flange of this invention; and FIG. 11 is a plan view of a conventional cage-type yarn feeding drum.

DETAILED DESCRIPTION OF THE PREFERRED EMBODIMENTS

Figure 1:
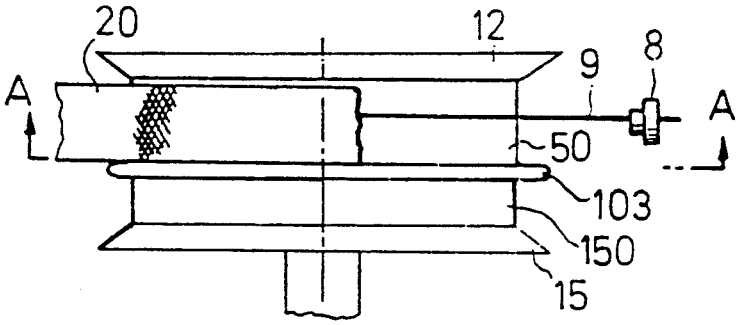
FIG. 1 is a plan view of the first embodiment of the present invention.
Figure 2:
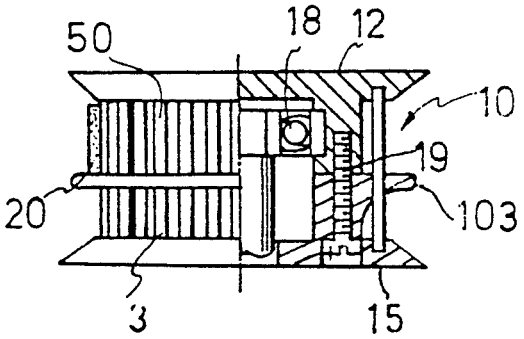
FIG. 2 is a plan view of the second embodiment thereof.
Figure 3:
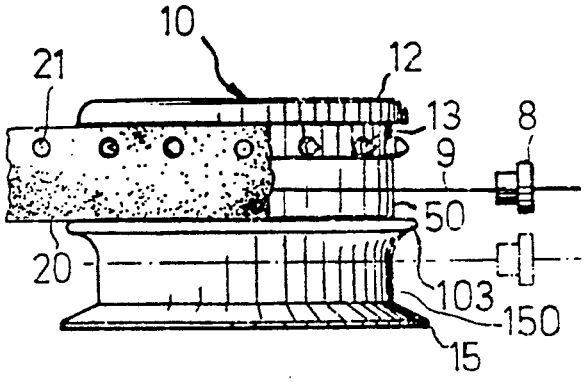
FIG. 3 is a plan view of the third embodiment thereof.
Figure 4A:
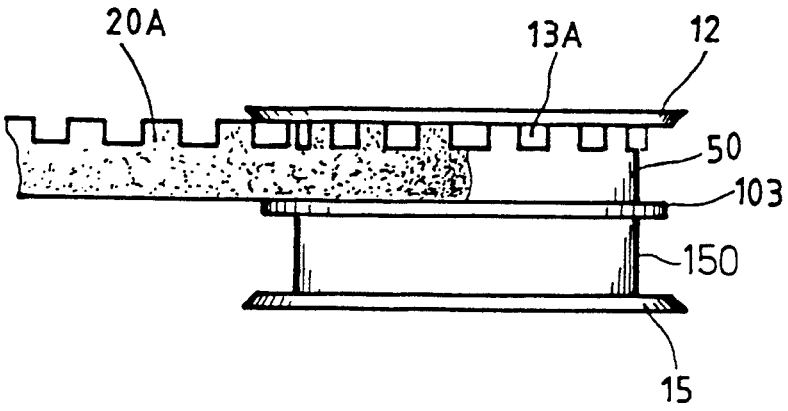
FIG. 4A is a plan view of the fourth embodiment thereof.
Figure 4B:
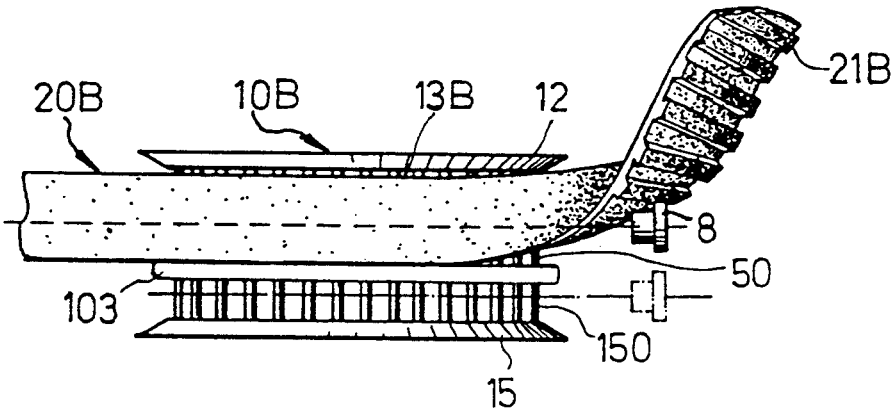
FIG. 4B is a plan view of the fifth embodiment thereof.

There are various kinds of yarn feeding drums, wherein the yarn feeding drums employing driving belt to press yarns on the circumferential surface of the drum for feeding the yarns can be divided into two types with respect to their driving manners, one of which feeds the yarn by the frictional force between the driving belt and the yarn feeding drum, as shown in FIGS. 1 and 2, and the other of which feeds the yarn by the engagement therebetween, as shown in FIGS. 3, 4A and 4B. The present invention is suitable for both the above two types of the yarn feeding drums. The basic structures of yarn feeding drums shown in FIGS. 1, 2, 3, 4A and 4B are not included in the present invention and are used to illustrate the application of the present invention thereto, so that the detailed description of these structures are omitted herein.

Please refer to FIGS. 1 to 4B. The present yarn feeding drum 10 includes an annular flange 103 as shown in FIG. 7, or a substantially annular flange 103 having at least one recess 105 as shown in FIG. 8, or an annular flange 103 having at least one lug 104 as shown in FIG. 9 (the lug can also directly extend outward from the circumferential surface of the yarn feeding drum 10), or an annular flange 103 having at least one smooth cut 105A as shown in FIG. 10. The annular flange 103 is located at a lower edge portion of a pressing area of a driving belt 20 on the circumferential surface 50 of the drum 10. The flange 103 extends outward from the lower edge portion of the pressing area with a diameter slightly larger than that of the drum 10 as shown in FIG. 7, whereby the yarn 9 and driving belt 20 are located between a lower edge of an upper cover of the drum 10 and an upper edge of the annular flange 103. Even in case the yarn wound on the tapered cone or tube is poor, or the yarn feeding resistance is relatively large to cause abnormal yarn feeding with intermittent shaking, or a rough count yarn with larger weight is fed at high speed, the yarn is prevented from slipping out of the pressing area of the driving belt on the circumferential surface 50 of the drum 10. Even if the yarn really slips away, the annular flange 103 can instantly guide the yarn and restore the yarn to its true position. Therefore, a stably and correct yarn feeding operation can be insured. Moreover, in case the driving belt is accidentally displaced from its original position and becomes unable to press the yarn on the circumferential surface of the drum, the annular flange 103 can also immediately guide the driving belt in an inclined direction and restore the driving belt to the annular rail between the lower edge of the upper cover 12 and the upper edge of the annular flange 103. Therefore, the annular flange of the present invention not only can avoid the slippage of the yarn and keep a stable yarn feeding operation, but also can instantly restore the displaced driving belt to its true position. As a result, the quality of the fabric can be significantly promoted.

Figure 5A:
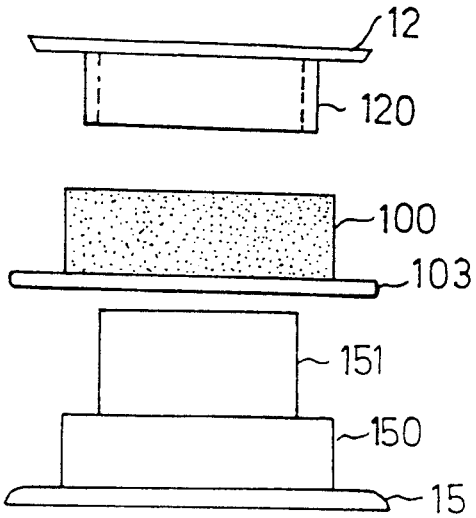
FIGS. 5A and 5B are plan views, showing one embodiment of the upper cover, lower cover and annular flange of the present invention.
Figure 5B:
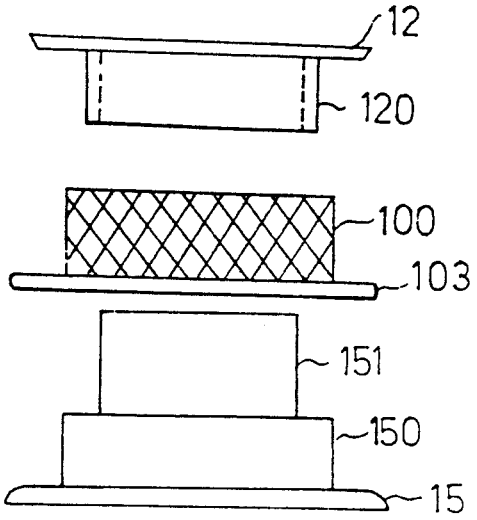

In a preferred embodiment of this invention, the annular flange 103 is solely molded and then assembled with an upper cover 12 and a lower cover 15 of the yarn feeding drum, as shown in FIG. 5. A lower hub 120 (receiving a not shown bearing) of the upper cover 12 is inserted in a hub 100 of the flange 103, while a small diameter hub 151 of the lower cover 15 is in turn inserted in the lower hub 120 of the upper cover 12 with a large diameter hub 150 of the lower cover 15 abutting against the lower surface of the flange 103. A screw then can be used to secure the upper cover 12, annular flange 103 and lower cover 15 together. Alternatively, the annular flange 103 can be integrally molded with the lower cover 15 and then secured to the upper cover 12. As shown in FIG. 6, the annular flange 103 is integrally molded with the lower cover 15. The upper hub 100 of the flange 103 receives the lower hub 120 of the upper cover 12, which in turn receives a bearing 60 therein. The latter alternative is easier to be manufactured and assembled, while the former alternative is more convenient in part replacement and maintenance.

As hereinbefore described with reference to FIGS. 1–10, the flange 103 of this invention closely limits the driving belt 20 and the yarn 9 to operate between the lower edge of the upper cover and the upper edge of the flange 103, so that in case the yarn or the driving belt is displaced from its true position accidentally, the flange 103 can instantly restore the yarn or the driving belt to its original true position for continuously normally feeding the yarn.

It should be noted that the diameter of the flange 103 only needs to be slightly larger than that of the yarn feeding drum for achieving the above guiding and restoring effects. Also, the flange 103 is not necessary to be annular, and can be substituted by at least one flange or lug 104. No matter how the flange 103 is shaped, the flange 103 can restore the yarn or driving belt to its true position in a vibration guiding manner. However, in case the flange 103 extends outward by a larger dimension or the frictional coefficient of the surface thereof is very small, for better restoring the driving belt to its true position in vibration manner and permitting an operator to operate the yarn guiding frame so as to conduct the yarn outside the flange 103 to a lower side thereof or to an upper side thereof, the annular flange i-s preferably provided with at least one rough area with larger frictional coefficient or provided with recesses 105, 105A. On the contrary, in case the flange 103 extends outward by a smaller dimension, for still instantly restoring the displaced driving belt to its true position in vibration manner, the circumference of the flange 103 is provided with at least an outward protruding lug 104 as shown in FIG. 9. Alternatively, the lug 104 can directly extend outward from the circumferential surface of the yarn feeding drum. Therefore, the flange of this invention can completely avoid accidental abnormal displacement of the yarn of the driving belt without affecting the operation of non-yarn feeding or negative yarn feeding in which by manually operating the yarn guiding frame, the yarn is conducted to a press-free area of the circumferential surface of the yarn feeding drum under the flange 103.

Figure 6A:
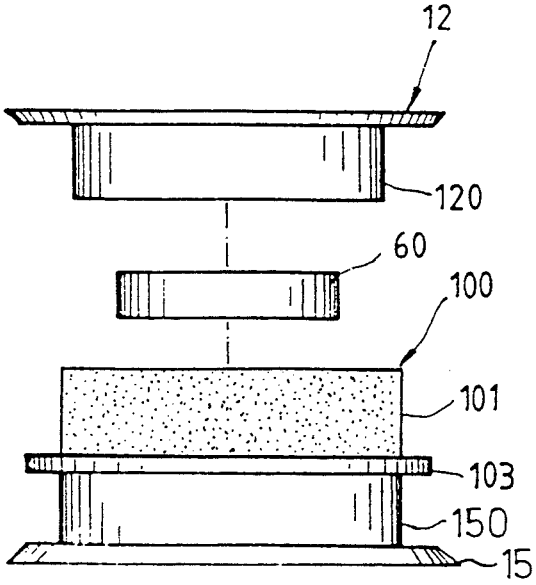
FIGS. 6A and 6B are plan views, showing another embodiment of the annular flange of the present invention.
Figure 6B:
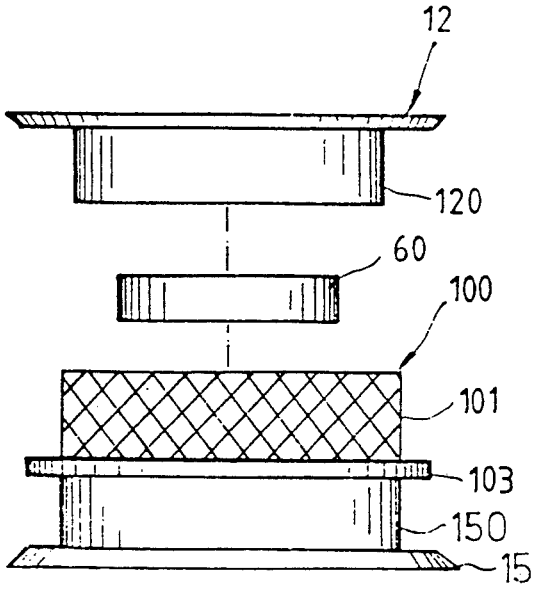

It is to be understood that in the above embodiment, if the circumferential surface 50 of drum 10 in FIGS. 1 to 4, or the outer surface of hubs 100 and 101 in FIGS. 5 and 6, is provided by a frictional surface for gripping the yarn, such as, a rubberized surface as shown in FIGS. 5A, 6A or a knurling circumferential periphery with a suitable larger frictional coefficient, the function and effect of yarn feeding will be much better.

If should be noted that each of the yarn feeding drums shown in FIGS. 1 to 4B also includes a circumferential portion 150 under the flange 103, which is not pressed by the driving belt 20 for the operation of non-yarn feeding or negative yarn feeding. However, in case the yarn feeding drum is used in a specifically designed textile machine for producing a single specification of fabric, the portion 150 can be deleted to reduce the height of the yarn feeding drum without affecting the functions and objects of this invention. Such yarn feeding drum should also fall within the scope of this invention.

What is claimed is:

1. A yarn feeding drum with a guiding flange comprising:

an upper cover;

a lower cover;

a drum body having a circumferential surface disposed between said upper and lower covers, said surface having a first yarn feeding area pressed by the driving belt and a second non-yarn feeding area not pressed by the driving belt, wherein a guiding flange extends outwardly from a lower portion of said first yarn feeding area of said circumferential surface at a position so that the area bounded by said upper cover of the drum and said flange is approximately equal in width to the driving belt, so that the flange acts as a guide and limits the yarn and driving belt to operate between a lower edge of said upper cover and an upper edge of said flange, wherein said flange has at least one recess, whereby in case the yarn of driving belt is displaced accidentally, said flange can instantly restore the yarn or driving belt to its proper position to ensure continued normal feeding of the yarn.

2. The yarn feeding drum as claimed in claim 1 wherein the flange is a substantially annular flange having a diameter slightly larger than that of said drum body.

3. The yarn feeding drum as claimed in claim 1, wherein said first yarn feeding area of said circumferential surface is formed by a rubberized circumferential surface.

4. The yarn feeding drum as claimed in claim 1, wherein said first yarn feeding area of said circumferential surface is formed by a knurled circumferential surface.

5. A yarn feeding drum with a guiding flange comprising:

an upper cover;

a lower cover;

a drum body having a circumferential surface disposed between said upper and lower covers, said surface having a first yarn feeding area pressed by the driving belt and a second non-yarn feeding area not pressed by the driving belt, wherein a guiding flange extends outwardly from a lower portion of said first yarn feeding area of said circumferential surface at a position so that the area bounded by said upper cover of the drum and said flange is approximately equal in width to the driving belt, so that the flange acts as a guide and limits the yarn and driving belt to operate between a lower edge of said upper cover and an upper edge of said flange, wherein the outer circumference of said flange is further formed with at least one outward extending lug, whereby in case the yarn of driving belt is displaced accidentally, said flange can instantly restore the yarn or driving belt to its proper position to ensure continued normal feeding of the yarn.

6. The yarn feeding drum as claimed in claim 5, wherein the flange is a substantially annular flange having a diameter slightly larger than that of said drum body.

7. The yarn feeding drum as claimed in claim 5, wherein said first yarn feeding area of said circumferential surface is formed by a rubberized circumferential surface.

8. The yarn feeding drum as claimed in claim 5, wherein said first yarn feeding area of said circumferential surface is formed by a knurled circumferential surface.

* * * * *